US009354607B2

(12) United States Patent
Hessler et al.

(10) Patent No.: US 9,354,607 B2
(45) **Date of Patent: *May 31, 2016**

(54) FREQUENCY REGULATION OF A TIMEPIECE RESONATOR VIA ACTION ON THE ACTIVE LENGTH OF A BALANCE SPRING

(71) Applicant: The Swatch Group Research and Development Ltd, Marin (CH)

(72) Inventors: Thierry Hessler, St-Aubin (CH); Davide Sarchi, Renens (CH); Marc Stranczl, Nyon (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

This patent is subject to a terminal disclaimer.

(21) Appl. No.: 14/620,430

(22) Filed: Feb. 12, 2015

(65) Prior Publication Data

US 2015/0234352 A1 Aug. 20, 2015

(30) Foreign Application Priority Data

Feb. 17, 2014 (EP) ..... 14155431

(51) Int. Cl.
*G04B 17/00* (2006.01)
*G04B 18/02* (2006.01)
*G04B 17/06* (2006.01)

(52) U.S. Cl.
CPC ..... *G04B 17/00* (2013.01); *G04B 17/063* (2013.01); *G04B 18/02* (2013.01)

(58) Field of Classification Search
CPC ..... G04B 17/06; G04B 17/063; G04B 17/20; G04B 17/30; G04B 18/02; G04B 17/00; G04B 17/26; G04C 3/04; G04C 3/042
USPC ..... 368/170, 175, 178, 200, 202
See application file for complete search history.

(56) References Cited

U.S. PATENT DOCUMENTS 2,724,946 A * 11/1955 Von Aesch ..... G04B 18/02 368/170
3,451,210 A * 6/1969 Helterline, Jr. ..... G04C 11/084 368/158

(Continued)

FOREIGN PATENT DOCUMENTS

CH 442 153 3/1967
CH 615 314 1/1980

(Continued)

OTHER PUBLICATIONS

European Search Report issued Oct. 31, 2014 in European Application 14155431, filed on Feb. 17, 2014 ( with English Translation).

*Primary Examiner* — Amy Cohen Johnson
*Assistant Examiner* — Matthew Powell
(74) *Attorney, Agent, or Firm* — Oblon, McClelland, Maier & Neustadt, L.L.P

(57) ABSTRACT

Method for maintaining and regulating the frequency of a timepiece resonator mechanism around its natural frequency (ω0) Includes a regulator device acting on the resonator with a periodic motion which requires a periodic modulation of at least the resonant frequency of said resonator, by requiring at least a modulation of the active length of a spring in the resonator mechanism, with a regulation frequency (ωR) that is between 0.9 times and 1.1 times the value of an integer multiple of the natural frequency (ω0). The integer is greater than or equal to 2 and less than or equal to 10.

21 Claims, 2 Drawing Sheets

(56) References Cited

U.S. PATENT DOCUMENTS

| | | | | |
|---|---|---|---|---|
| 5,740,131 | A * | 4/1998 | Bernasconi | G04C 10/00 368/148 |
| 7,306,364 | B2 * | 12/2007 | Born | G04B 17/063 368/148 |
| 2007/0091729 | A1 * | 4/2007 | Takahashi | G04B 17/06 368/170 |
| 2010/0283556 | A1 | 11/2010 | Hessler et al. | |
| 2011/0222377 | A1 * | 9/2011 | Ching | G04B 17/066 368/175 |
| 2013/0107677 | A1 * | 5/2013 | Willemin | G04C 3/042 368/200 |
| 2014/0286140 | A1 * | 9/2014 | Stranczl | G04B 15/14 368/127 |
| 2014/0286143 | A1 * | 9/2014 | Stranczl | G04B 18/025 368/178 |

FOREIGN PATENT DOCUMENTS

| | | | |
|---|---|---|---|
| CH | 705 605 | A2 | 4/2013 |
| DE | 1 217 883 | | 5/1966 |
| EP | 1 843 227 | A1 | 10/2007 |
| EP | 2 434 353 | A1 | 3/2012 |
| EP | 2 690 507 | A1 | 1/2014 |
| FR | 833 085 | | 10/1938 |

* cited by examiner

FREQUENCY REGULATION OF A TIMEPIECE RESONATOR VIA ACTION ON THE ACTIVE LENGTH OF A BALANCE SPRING

This application claims priority from European Patent Application No. 14155431.1 filed 17 Feb. 2014, the entire disclosure of which is incorporated herein by reference.

FIELD OF THE INVENTION

The invention concerns a method of maintaining and regulating the frequency of a timepiece resonator mechanism around its natural frequency.

The invention also concerns a timepiece movement including at least one resonator mechanism including at least one sprung balance assembly, whose balance spring is held between a balance spring stud at a first outer end and a collet at a second inner end.

The invention also concerns a timepiece including at least one such timepiece movement.

The invention concerns the field of time bases in mechanical watchmaking, in particular those based on a sprung balance resonator mechanism.

BACKGROUND OF THE INVENTION

The search for improvements in the performance of timepiece time bases is a constant preoccupation A significant limitation on the chronometric performance of mechanical watches lies in the use of conventional impulse escapements, and no escapement solution has ever been able to avoid this type of interference.

EP Patent Application No 1843227A1 by the same Applicant discloses a coupled resonator including a first low frequency resonator, for example around a few hertz, and a second higher frequency resonator, for example around one kilohertz. The invention is wherein the first resonator and the second resonator include permanent mechanical coupling means, said coupling making it possible to stabilise the frequency in the event of external interference, for example in the event of shocks.

CH Patent Application No 615314A3 in the name of PATEK PHILIPPE SA discloses a movable assembly for regulating a timepiece movement, including an oscillating balance maintained mechanically by a balance spring, and a vibrating member magnetically coupled to a stationary member for synchronising the balance. The balance and the vibrating member are formed by the same single, movable, vibrating and simultaneously oscillating element. The vibration frequency of the vibrating member is an integer multiple of the oscillation frequency of the balance.

SUMMARY OF THE INVENTION

The invention proposes to manufacture a time base that is as accurate as possible.

To this end, the invention concerns a method of maintaining and regulating the frequency a timepiece resonator mechanism around its natural frequency, wherein at least one regulation mechanism is implemented, acting on said resonator mechanism with a periodic motion, wherein said periodic motion imposes at least a periodic modulation of the resonant frequency of said resonator mechanism, by imposing at least a modulation of the active length of a spring comprised in said resonator mechanism with a regulation frequency which is comprised between 0.9 times and 1.1 times the value of an integer multiple of said natural frequency, said integer being greater than or equal to 2 and less than or equal to 10.

The invention also concerns a timepiece movement including at least one resonator mechanism including at least one sprung balance assembly, whose balance spring is held between a balance spring stud at a first outer end and a collet at a second inner end, wherein the movement includes at least one said regulator device controlling a periodic variation in the active length of said balance spring.

The invention also concerns a timepiece including at least one such timepiece movement.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
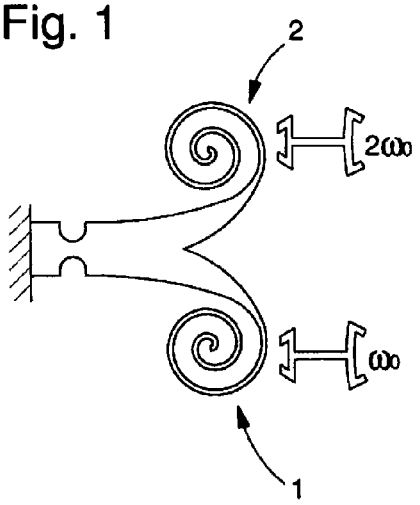
FIG. 1 shows a schematic view of a tuning fork with two sprung balances attached to each other.

It is an object of the invention to produce a time base for making a mechanical timepiece, particularly a mechanical watch, as accurate as possible.

One method of achieving this consists in associating different resonators, either directly or via the escapement.

To overcome the factor of instability linked to the escapement mechanism, a parametric resonator system makes it possible to reduce the influence of the escapement and thereby render the watch more accurate.

A parametric oscillator according to the invention utilises, for maintaining oscillations, parametric actuation which consists in varying one of the parameters of the oscillator with a regulation frequency ωR which is comprised between 0.9 times and 1.1 times the value of an integer multiple of the natural frequency of the oscillator system to be regulated, said integer being greater than or equal to 2 and less than or equal to 10. This regulation frequency ωR is preferably an integer multiple, notably two (double), of the natural frequency ω0.

By convention and in order to differentiate clearly between them, "regulator" 2 refers here to the oscillator used for maintaining and regulating the other maintained system, which is referred to here as "the resonator" 1.

The Lagrangian L of a parametric resonator of dimension 1 is:

$$L = T - V = \frac{1}{2}I(t)\dot{x}^2 - \frac{1}{2}k(t)[x - x_0(t)]^2$$

where T is the kinetic energy and V the potential energy, and the inertia I(t), rigidity k(t) and rest position $x_0(t)$ of said resonator are a periodic function of time, x is the generalized coordinate of the resonator.

The forced and damped parametric resonator equation is obtained via the Lagrange equation for Lagrangian L by adding a forcing function f(t) and a Langevin force taking account of the dissipative mechanisms:

$$\frac{\partial^2 x}{\partial^2 t} + \gamma(t)\frac{\partial x}{\partial t} + \omega^2(t)[x - x_0(t)] = f(t)$$

where the coefficient of the first order derivative at x is:

$$\gamma(t)=[\beta(t)+i(t)]/I(t),$$

β(t)>0 being the term describing losses, and where the coefficient of zero order term depends on the resonator frequency $\omega(t)=\sqrt{k(t)/I(t)}$. The function $f(t)$ takes the value 0 in the case of a non-forced oscillator.

This function f(t) may also be a periodic function, or be representative of a Dirac impulse.

The invention consists in varying, via the action of an oscillator used for maintenance or regulation, the active length and therefore the rigidity k(t) of said resonator (1) with a regulation frequency that is comprised between 0.9 times and 1.1 times the value of an integer multiple of the natural frequency ω0 of the oscillator system to be regulated, this integer being greater than or equal to 2 and less than or equal to 10.

In a particular embodiment, the regulation frequency ωR is an integer multiple, particularly two, of the natural frequency ω0 of the resonator system to be regulated.

In an alternative version, in addition to the rigidity of the resonator (1), all the terms β(t), I(t), $x_0(t)$, vary with a regulation frequency ωR which is preferably an integer multiple (particularly two) of the natural frequency ω0 of the resonator system to be regulated.

Generally, in addition to modulating the parametric terms, the oscillator used for maintenance or regulation therefore introduces a non-parametric maintenance term $f(t)$, whose amplitude is negligible once the parametric regime is attained.

In a variant, the forcing term f(t) may be introduced by a second maintenance mechanism.

The parameters of this equation are frequency and the friction term 13. The oscillator quality factor is defined by Q=ω/β.

To better understand the phenomenon, it can be likened to the example of a pendulum whose length is varied. In such case, $$\omega^2 = \frac{g}{L}$$

where L is the length of the pendulum and g the attraction of gravity.

In this particular example, if length L is modulated in time periodically with a frequency 2ω and sufficient modulation amplitude δL (δL/L>2β/ω), the system oscillates at frequency ω without damping itself.

The principle can be used, in particular but in a non-limiting manner, in a timepiece or a watch which includes a mechanical sprung balance resonator, with one end of the balance spring fixed to a collet integral with the balance, and the other end fixed to a balance spring stud.

Parametric maintenance of this type of sprung balance system can be achieved notably by periodically making the balance spring stud movable.

Oscillation can be maintained and the accuracy of the system is clearly improved.

The specific choice of an excitation oscillator frequency which is double the frequency of the system whose oscillation regularity is required to be stabilised makes it possible to perform modulation over one complete vibration, and to obtain zero or negative damping.

Industrialisation of these parametric oscillator systems is connected to the two essential functions: the supply of energy and counting.

These two functions may be separated, as illustrated in FIG. 1, by using a tuning fork with two sprung balances attached to each other, wherein one oscillating at a frequency 2ω is linked to the escapement, and the other oscillating at a frequency ω is linked to the counting function. FIG. 1 illustrates the general principle of the invention of regulation by means of a harmonic oscillator. The particular object of the invention, which concerns the modulation of the active length of a spring comprised in a resonator mechanism, is illustrated by the other Figures.

It may be preferred to modify friction losses in the air rather than causing the frequency term to oscillate (which corresponds, in the case of a sprung balance, to varying the inertia or rigidity), or to modify the inertia of the balance by means of an unbalance.

For maximum efficiency, maintenance is advantageously performed with an integer multiple frequency, notably two, of the maintained resonator frequency. The mechanical maintenance means may take various forms.

Thus, the invention concerns a method for maintaining and regulating the frequency of a timepiece resonator mechanism 1 around its natural frequency ω0.

According to the invention, there is implemented at least one regulator device 2 acting on said resonator mechanism 1 with a periodic motion.

This periodic motion requires at least a periodic modulation of the resonant frequency of resonator mechanism 1, with a regulation frequency ωR which is comprised between 0.9 times and 1.1 times the value of an integer multiple of the natural frequency ω0, this integer being greater than or equal to 2 and less than or equal to 10.

In a particular variant of the invention, the periodic motion imposes at least a periodic modulation of the resonant frequency, and of the quality factor and/or rest point, of said resonator mechanism 1, with a regulation frequency ωR which is comprised between 0.9 times and 1.1 times the value of an integer multiple of natural frequency ω0, this integer being greater than or equal to 2 and less than or equal to 10.

Advantageously, the periodic motion imposes a periodic modulation of the resonant frequency of resonator mechanism 1, by acting on at least the rigidity of resonator mechanism 1.

In a particular variant, the periodic motion imposes a periodic modulation of the resonant frequency of resonator mechanism 1 by imposing a modulation of the rigidity of resonator mechanism 1 and a modulation of the inertia resonator mechanism 1.

Specifically, when resonator mechanism 1 includes at least one return means formed by a spring or suchlike, the periodic motion imposes a periodic modulation of the resonant frequency of resonator mechanism 1, by imposing at least a modulation of the active length of a spring comprised in resonator mechanism 1.

In a specific variant, the periodic motion imposes a periodic modulation of the resonant frequency of resonator mechanism 1, by imposing at least a modulation of the active length of a spring comprised in resonator mechanism 1 and/or a modulation of the section of a spring comprised in resonator mechanism 1, and/or a modulation of the modulus of elasticity of a return means comprised in resonator mechanism 1, and/or a modulation of the form of a return means comprised in resonator mechanism 1.

The invention, as illustrated, more specifically concerns the frequency regulation of a timepiece resonator with action on the active length of a balance spring.

The present invention consists in varying the active length and therefore the rigidity of the balance spring.

It is known to limit the active length of a balance spring through the use of an index mechanism with pins, including an index carrying two pins between which the balance spring passes, the limitation on active length resulting from the contact of the balance spring with at least one of the pins.

The active length of the balance spring can be varied:

in a binary manner: the balance spring may have two useful lengths, with no intermediate state;

in a continuous manner.

Figure 2:
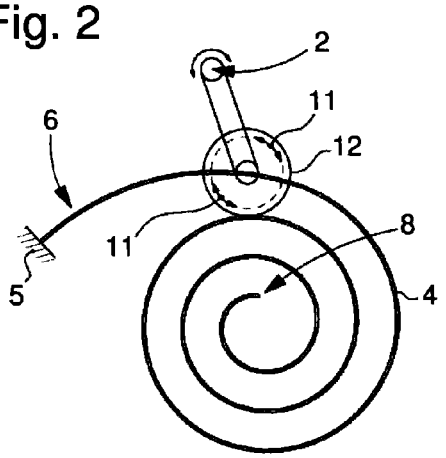
FIG. 2 shows a schematic view of a balance spring provided with an index mechanism with two pins, with an index pivoting between two different contact positions wherein the two pins comprised in the index clamp the outer coil of the balance spring, to vary the active length of the spring in a discrete manner.

To vary the active length of the balance spring in a binary manner, a first simple solution consists in arranging the pair of index pins to pivot between two different contact positions wherein the two pins clamp the outer coil of the balance spring to vary the active length, as seen in FIG. 2. (This also causes a slight rotation of the balance spring which can assist self-starting). In this precise case, the active length can be varied in a binary manner and the rest point, and therefore two parameters, are modified).

Figure 3:
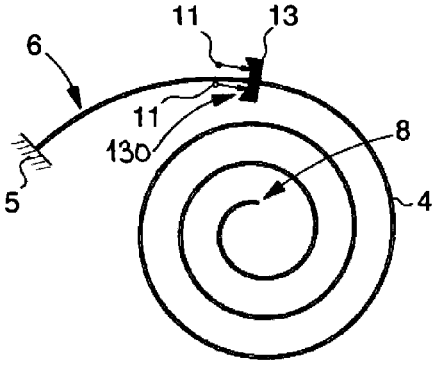
FIG. 3 shows a schematic view of a balance spring provided with an index mechanism with two pins, said balance spring carrying a structure comprising a housing devised to accommodate at least one of the two pins, or both pins, said structure integral with the balance spring being arranged to be locked with the pins, to vary the active length of the balance spring in a discrete manner.

A second solution consists in fitting the balance spring with a structure comprising a housing devised to accommodate at least one pin, or both pins if the index has two, this integral structure of the balance spring is locked with the pins, as seen in FIG. 3. This variation is binary. It is also possible to change the active length, in accordance with a similar principle, in a certain number of steps defined by as many non-locking elastic notches on the coil, each arranged to cooperate, either with a single pin, or with a conventional pair of pins. A structure of this type is known from EP Patent No 2434353 in the name of MONTRES BREGUET SA.

Figure 4:
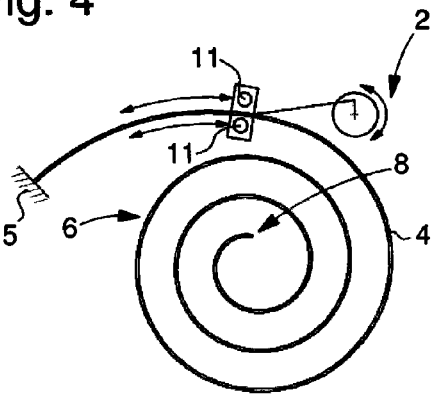
FIG. 4 shows a schematic view of a balance spring provided with an index mechanism with two pins, with a crank rod system for actuating a continuous motion of the index, for a continuous variation in the active length of the balance spring.

To vary the active length of the balance spring in a known manner, a third solution visible in FIG. 4 consists in providing the mechanism with a crank rod system for actuating the index, as seen in FIG. 4, where the two pins 11 of the index 12 each describe an arc, thereby modifying the active length in a continuous manner.

Figure 5:
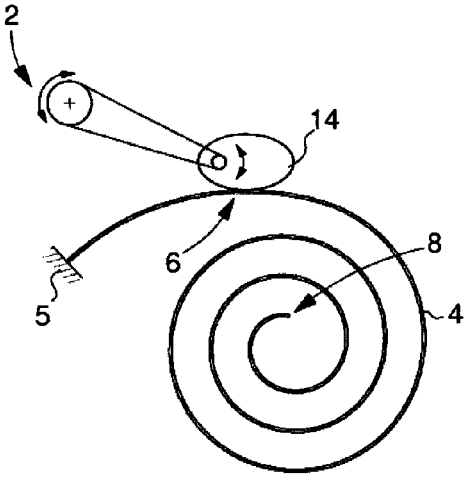
FIG. 5 shows a schematic view of a balance spring on which a cam presses, for a continuous variation in the active length of the balance spring.

A fourth solution allows the active length to be continuously varied with a cam, as seen in FIG. 5. Unlike the preceding solutions, the prestressing of the balance spring and the radial position of the counting point also vary over time.

Figure 6:
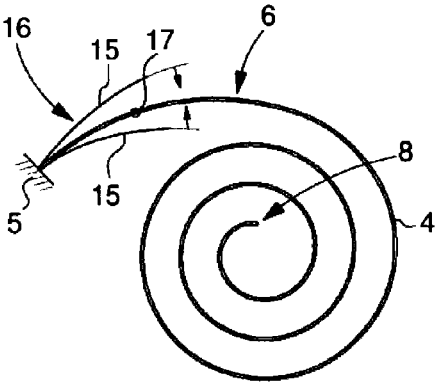
FIG. 6 shows a schematic view of a balance spring which is clamped in proximity to its stud by two flexible strips, positioned either side of the balance spring in proximity to the stud, and which clamp the terminal curve thereof, for a continuous variation in the active length of the balance spring.
Figure 7:
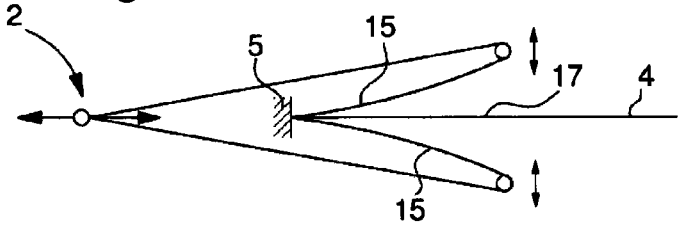
FIG. 7 shows a variant of FIG. 6 wherein the flexible guide system actuates the two flexible strips from a single motion, for a continuous variation in the active length of the balance spring.
Figure 8:
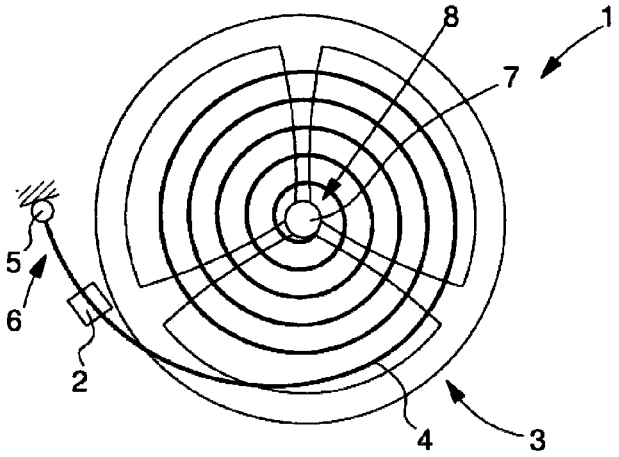
FIG. 8 shows a schematic view of a resonator mechanism including a sprung balance assembly, whose balance spring is held between a stud at a first outer end and a collet at a second inner end, and a regulator device controlling a periodic variation in the active length of the balance spring.
Figure 9:
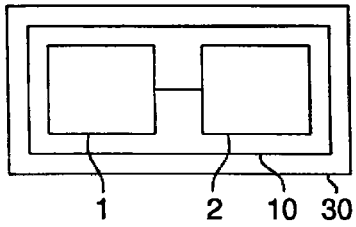
FIG. 9 shows a block diagram of a watch including a mechanical movement with a resonator mechanism regulated according to the invention.

A fifth solution consists in continuously varying the active length of the balance spring with two flexible strips, which are positioned on either side of the balance spring in proximity to the balance spring stud, and which clamp the terminal curve thereof, as seen in FIG. 6. A flexible guiding system can actuate the two strips from a single motion, as seen in FIG. 7: in this variant strips 15 may be elastic or rigid, and their ends opposite the balance spring stud may be held by springs.

Some of these mechanisms may be combined with each other, for example, and in a non-limiting manner, those of FIGS. 2 and 6, of FIGS. 2 and 4 or of FIGS. 4 and 6 or others. In particular, magnets may advantageously be used to vary the active length of the balance spring.

These mechanisms may, also, be combined with a mechanism modifying the rigidity of the balance spring, such as a rotating wheel set provided with magnets at the periphery thereof and periodically cooperating with a magnet placed on the terminal curve of the balance spring, or other element.

Likewise, electrostatic elements or layers may be implemented to vary the active length of the balance spring. It is also possible to envisage, in a hybrid environment, being able to modify the rigidity of a balance spring by partially or completely covering it with a piezoelectric layer actuated by a small electronic module.

A parametric escapement with a crank rod system makes it possible to periodically move the index pin(s), or the index itself, or flexible strips.

It is not essential to have sinusoidal excitation, excitation at twice the frequency can be performed by a multi-frequency periodic signal, i.e. superposition of sinusoidal signals, or by a square signal (step-function). In a specific embodiment, superposition is performed of sinusoidal signals whose frequencies are even multiples of the resonator frequency.

The maintenance regulator does not need to be very accurate: any lack of accuracy results only in a loss of amplitude, but with no frequency variation (except of course if the frequency is very variable, which is to be avoided). In fact, these two oscillators, the regulator that maintains and the maintained resonator, are not coupled, but one maintains the other, in a single direction.

In a preferred embodiment, there is no coupling spring between these two oscillators.

It is quite clear that the invention differs from known coupled oscillators: indeed, the implementation of the invention does not require reversibility of the transfer of energy between two oscillators is not desired, but rather, insofar as possible, a transfer of energy in a single direction from one oscillator to the other.

In a specific variant of the invention, a continuous and monotonous motion of the counting-rest function is also performed.

Thus, the invention concerns a method of regulating the frequency of a timepiece resonator mechanism 1 around its natural frequency ω0. This method implements at least one regulator device 2 imposing a periodic variation in the active length of said resonator 1.

According to the invention, the periodic motion is imparted with a regulation frequency which is comprised between 0.9 times and 1.1 times the value of an integer multiple of said natural frequency, this integer being greater than or equal to 2 and less than or equal to 10.

According to the invention, this method is applied to a resonator mechanism 1 including at least one sprung balance assembly 3, whose balance spring 4 is held between a balance spring stud 5 at a first outer end 6 and a collet 7 at a second inner end 8 and at least one regulator device 2 is made to act by controlling a periodic variation in the active length of balance spring 4.

In a preferred implementation, the regulation frequency ωR is double the natural frequency ω0.

The present description presents hereinafter different variants described with an index including two pins on either side of the balance spring, in a conventional arrangement, which constitutes an advantageous embodiment, but which is not limiting. In particular, it is perfectly possible to use a single pin to modify the useful length of the balance spring. Only embodiments with two pins are illustrated in the Figures.

In a first implementation of the method, resonator mechanism 1 is provided with an index mechanism including at least one index pin 11, and the length of balance spring 4 is varied in a discrete or binary manner, in two lengths with no intermediate state between the two lengths.

In a first variant of this first embodiment, the index mechanism is provided with a pivoting index 12 including at least one index pin 11, notably two index pins 11, and the periodic pivoting of index 12 is controlled to modify periodically the contact points between at least one said pin 11, more particularly pins 11, and balance spring 4 in order to modify the useful length of balance spring 4.

In a second variant of this first embodiment, balance spring 4 is provided with a structure 13 including a housing 130 devised to receive at least one said pin 11, or two pins 11, and at least one pin 11 is moved to be housed inside structure 13 integral with balance spring 4 which is locked with pin or pins 11.

In a second implementation of the method, the length of balance spring 4 is continuously varied.

In a first variant of this second implementation, resonator mechanism 1 is provided with an index mechanism having an index 12 including at least one index pin 11, particularly two index pins 11, and a regulator device 2, including a crank rod system, is used to continuously actuate and move index 12.

In a second variant of this second implementation, a regulator device 2, including a cam 14, is used to continuously modify the useful length of balance spring 4 by modifying the position along balance spring 4 of the contact point between cam 14 and balance spring 4.

In a third variant of this second implementation, a regulator device 3 is used including two flexible strips 15 arranged on either side of balance spring 4, and flexible strips 15 are pressed onto balance spring 4 in an arc of contact 16 of continuously variable length with terminal curve 17 of balance spring 4. More specifically, a regulator device 2 is used including a flexible guiding system to actuate the two flexible strips 15 from a single motion.

Other variant implementations of the invention are also possible. It is possible, in particular, to envisage modifying the active length of balance spring 4 via its centre, rather than via its periphery. It is also possible to act on the intermediate coils of the balance spring, for example by using mechanisms for coupling the coils to each other, as used in the anti-trip systems disclosed in EP2434353 in the name of MONTRES BREGUET SA, or any other system enabling one portion of the variable length of the balance spring to be made rigid.

Figure 10:
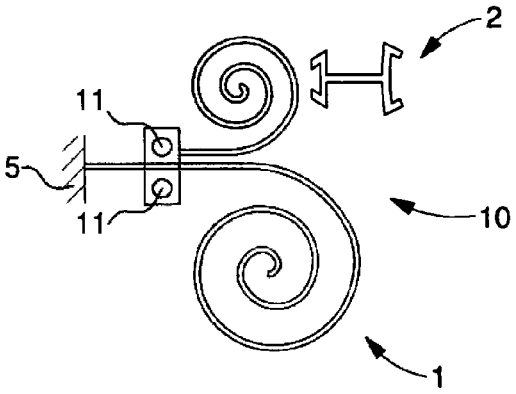
FIG. 10 shows a variant of FIG. 4, wherein one of the pins is at the outer end of a first dual frequency resonator, which performs the coupling.

FIG. 10 also shows a variant of FIG. 4, wherein at least one of the pins is at the outer end of a first double frequency resonator, which performs the coupling. The oscillators may also advantageously be superposed.

Figure 11:
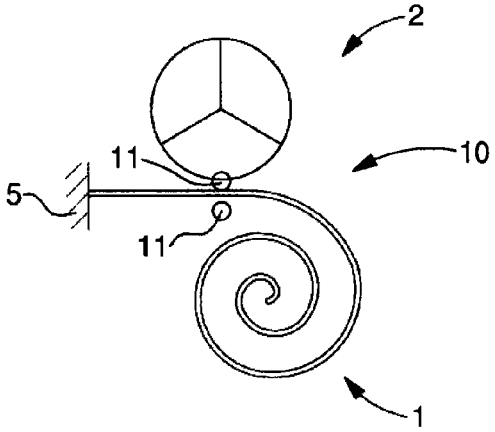
FIG. 11 shows the principle of modification of the active length of the balance spring by another dual frequency resonator, and wherein at least one of the pins is located on a balance.

FIG. 11 shows the principle of modification of the active length of the balance spring by another double frequency resonator, and wherein at least one of the pins is located on a balance. Here too, the systems may be superposed.

The variants described here are non-limiting, since it is possible to imagine integrating all types of resonators, beams, flexible guide members or other elements.

Advantageously, the relative modulation amplitude of the natural frequency of sprung balance 3 is greater than the inverse of the quality factor of sprung balance 3.

The active length of the spring, particularly of the balance spring, may also be modified by local modification of the rigidity of the spring, particularly of the balance spring, obtained through the use of magnets and/or electrostatic layers-components, particularly electrets.

The invention also concerns a timepiece movement 10 including at least one timepiece resonator mechanism 1 including at least one sprung balance assembly 3 whose balance spring 4 is held between a balance spring stud 5 at a first outer end 6 and a collet 7 at a second inner end 8. This movement 10 includes at least one regulator device 2 controlling a periodic variation in the active length of balance spring 4.

In a variant, this movement 10 includes an index mechanism with index pins 11 including a pivoting index 12 including at least one index pin 11, particularly two index pins 11 and regulator device 2 controls the periodic pivoting of index 12 to periodically modify the contact points between at least one pin 11 and balance spring 4 to modify the useful length of balance spring 4.

In another variant, this movement 10 includes an index mechanism including at least one index pin 11, particularly two index pins 11 and balance spring 4 includes a structure 13 including a housing 130 devised to accommodate at least one pin 11, or both pins 11 if the index has two, and regulator device 2 controls the periodic motion of at least one of pins 11 to house the pin inside the structure 13 integral with balance spring 4, which is locked with at least one pin 11.

In a variant, this movement 10 includes an index mechanism with index pins 11 including an index 12 including at least one index pin 11, particularly two index pins 11, and regulator device 2 includes a crank rod system for continuously actuating and moving index 12.

In a variant, this movement 10 includes a regulator device 2 including a cam 14 for continuously modifying the useful length of balance spring 4 by modifying the position along balance spring 4 of the contact point between cam 14 and balance spring 4.

In a variant, this movement 10 includes a regulator device 2 including two flexible strips 15 arranged on either side of balance spring 4, and which presses flexible strips 15 onto balance spring 4 in an arc of contact 16 of continuously variable length with terminal curve 17 of balance spring 4. More specifically, this regulator device 2 includes a flexible guiding system for actuating the two flexible strips 15 from a single motion.

The invention also concerns a timepiece 30 including at least one such timepiece movement 10.

What is claimed is:

1. A method of maintaining and regulating a frequency of a timepiece resonator mechanism around a natural frequency thereof, comprising:

acting with at least one regulator device on said resonator mechanism with a periodic motion, wherein said periodic motion requires at least a periodic modulation of the resonant frequency of said resonator mechanism, by requiring at least a modulation of an active length of a spring comprised in said resonator mechanism with a regulation frequency which is comprised between 0.9 times and 1.1 times a value of an integer multiple of said natural frequency, said integer being greater than or equal to 2 and less than or equal to 10.

2. The method according to claim 1, wherein the periodic motion requires a periodic modulation of the resonant frequency of said resonator mechanism, by also requiring at least a modulation of the section of a spring comprised in said resonator mechanism and/or a modulation of the modulus of elasticity of a return means comprised in said resonator mechanism, and/or a modulation of the form of a return means comprised in said resonator mechanism.

3. The method according to claim 1, wherein said resonator mechanism includes at least one sprung balance assembly, including a balance spring held between a balance spring stud at a first outer end and a collect at a second inner end and at least one regulator device is made to act by controlling a periodic variation in the active length of said balance spring.

4. The method according to claim 3, wherein said resonator mechanism is provided with an index mechanism including at least one index pin, and said length of said balance spring is varied in a discrete or binary manner, in two lengths with no intermediate state between said two lengths.

5. The method according to claim 4, wherein said index mechanism is provided with a pivoting index carrying said at least one index pin, and wherein the periodic pivoting of said index is modified to periodically modify the points of contact between said at least one index pin and said balance spring in order to modify the active length of said balance spring.

6. The method according to claim 4, wherein said balance spring is provided with a structure including a housing devised to accommodate said at least one index pin, and wherein said at least one index pin is moved to be housed inside said structure integral with said balance spring which is locked with said at least one index pin.

7. The method according to claim 3, wherein the active length of said balance spring is continuously varied.

8. The method according to claim 7, wherein said resonator mechanism is provided with an index mechanism comprising an index carrying at least one index pin, and wherein a regulator device, including a crank rod system, is used to continuously actuate and move said index.

9. The method according to claim 7, wherein said regulator device, including a cam, is used to continuously modify the useful length of said balance spring by modifying the position along said balance spring of the contact point between said cam and said balance spring.

10. The method according to claim 7, wherein said regulator device includes two flexible strips arranged on either side of said balance spring, and said flexible strips are pressed in an arc of contact of continuously variable length with the terminal curve of said balance spring.

11. The method according to claim 10, wherein said regulator device includes a flexible guiding system for actuating the two flexible strips from a single motion.

12. The method according to claim 1, wherein magnets and/or electrostatic layers-components and/or electrets are used for local modification of the rigidity of said spring causing a modification of the active length of said spring.

13. The method according to claim 1, wherein said regulation frequency is double said natural frequency.

14. A movement, comprising:

a least one timepiece resonator mechanism including at least one sprung balance assembly, whose balance spring is held between a balance spring stud at a first outer end and a collect at a second inner end, wherein said movement includes at least one regulator device arranged to control a periodic variation in an active length of said balance spring with a regulation frequency which is comprised between 0.9 times and 1.1 times a value of an integer multiple of a natural frequency, said integer being greater than or equal to 2 and less than or equal to 10.

15. The movement according to claim 14, wherein the movement includes an index mechanism with at least one index pin including a pivoting index carrying said at least one index pin, and wherein said regulator device controls the periodic pivoting of said index to periodically modify the points of contact of said at least one index pin and said balance spring in order to modify the active length of said balance spring.

16. The movement according to claim 14, wherein the movement includes an index mechanism with at least one index pin, and wherein said balance spring includes a structure comprising a housing devised to accommodate said at least one index pin, and wherein said regulator device controls the periodic motion of said at least one index pin to house said at least one index pin inside said structure integral with said balance spring, which is locked with said at least one index pin.

17. The movement according to claim 14, wherein the movement includes an index mechanism with at least one index pin comprising an index carrying said at least one index pin, and wherein said regulator device includes a crank rod system for continuously actuating and moving said index.

18. The movement according to claim 14, wherein said regulator device includes a cam for continuously modifying the useful length of said balance spring by modifying the position along said balance spring of the contact point between said cam and said balance spring.

19. The movement according to claim 14, wherein the regulator device includes two flexible strips arranged on either side of said balance spring and presses said flexible strips on said balance spring in an arc of contact of continuously variable length with the terminal curve of said balance spring.

20. The movement according to claim 19, wherein said regulator device includes a flexible guiding system for actuating the two said flexible strips from a single motion.

21. A timepiece comprising:

at least one movement according to claim 14.

* * * * *